US005086822A

United States Patent [19]

Keighler

[11] Patent Number: 5,086,822

[45] Date of Patent: Feb. 11, 1992

[54] ARCH TREATMENT

[76] Inventor: Howard V. Keighler, 1675 Glencove Ave., N.W., Palm Bay, Fla. 32907

[21] Appl. No.: 570,130

[22] Filed: Aug. 17, 1990

[51] Int. Cl.[5] ..... E04F 10/00

[52] U.S. Cl. ..... 160/38; 160/134

[58] Field of Search ..... 160/134, 38, 84.1; 52/203, 202

[56] References Cited

U.S. PATENT DOCUMENTS 4,699,195 10/1987 Lester ..... 160/134

*Primary Examiner*—Blair M. Johnson

*Attorney, Agent, or Firm*—Evenson, Wands, Edwards, Lenahan & McKeown

[57] ABSTRACT

An above-window arch treatment has a series of rectangular slats glued to one another and to a valence so as to form a "peacock's tail". The arch treatment is fabricated by a method which fixes an odd-number of slats about a pivot bolt passing through front and rear valences. The slats are alternated to the right and left of the pivot bolt. The slat most rearward, i.e., immediately adjoining the back valence, is moved perpendicular to the valences. The slats on the right hand side of the perpendicualr slat are sequentially joined to the perpendicular slat and then to each other. Likewise, the slats on the left-hand side of the perpendicular slat are sequentially joined to the perpendicular slat and then to each other unitl the desired arch form is achieved. The assembled slats can then be joined to the front valence or a flower box in front of the arch treatment can be proviced by joining the assembled slats to the rear valence.

17 Claims, 1 Drawing Sheet

ARCH TREATMENT

BACKGROUND AND SUMMARY OF THE INVENTION

The present invention relates to an improved above-window arch treatment and method of making same and, more particularly, to a "peacocks tail" arch treatment comprised of rectangular or stripped sections of synthetic material such as PVC which are arranged in accordance with the method radially with the centers of each slat joined in the middle at the bottom and overlaid with a horizontal slat.

Conventional window-arch treatments, while being fanconfigured, open radially either from the center bottom portion of the arch or on either side of the central vertical piece. Conventional accordion type fans have a short life since they are made of paper or fabric which deteriorates with exposure to the sun.

For instance, U.S. Pat. No. 4,699,195, discloses a collapsible blind for a semi-circular arched window which covers 270°-90° arched window by use of an overlapping slat configuration with a single pivot point. This blind starts with slats from 270° and 90° and converges to the zero degree position, i.e. from the sides toward the center or middle of the blind. The arrangement uses tape to space the slat, a U-shaped channel to guide the slats with tension springs and hinged rings and pivots to open and close the blind. The exposed pivot detracts, however, from the appearance of the blind. Moreover, this blind requires tape and the like which also makes it more complicated and further detracts from its appearance.

U S. Pat. No. 2,517,281, shows a semicircular awning collapsible around a pivot point. The slats are tapered and open from the center outward around the pivot point which is exposed. This awning is not intended to lay flat against a wall, but is designed to extend from the wall for the purposes of providing shade. Accordingly, the awning disclosed in this patent requires an adjusting cord and a semicircular metal arc to guide the tapered slats.

U.S. Pat. No. 2,875,825 discloses a semi-circular marquee for use in tropical climates similar to the above-described awning. This arrangement uses a more complicated double-pivot arrangement and tapered slats which alternate by means of an interlock mechanism so that they can open and close. A relatively complicated metal frame is provided which allows upward and downward pivoting by means of an actuating handle. Similar types of collapsible blinds and arch treatments are shown in, for example, U.S. Pat. No. 602,967; U.S. Pat. No. 1,447,189; and Design Patent No. 110,452. In addition, miscellaneous folding, collapsible structures for various other applications are known as shown in U.S. Pat. No. 693,826; U.S. Pat. No. 1,510,984; U.S. Pat. No. 1,613,364; and U.S. Pat. No. 2,728,115.

It is an object of the present invention to provide an attractive and easily constructed arch window treatment, also known as a "peacocks tail" arch treatment, in which a plurality of rectangular slats having a slightly convex-concave cross-section, as viewed along the shorter edge, can be glued together in a rapid and attractive manner to cover a 270°-90° arched window by using an overlapping slat configuration about a single pivot point.

It is another object of the present invention to provide a permanently glued and simply constructed arch treatment in which the need for miscellaneous items such as tapes, U-shaped channels, tension springs and hinged rings can be dispensed with, thereby greatly enhancing the aesthetic appearance of the window treatment.

It is yet another object of the present invention to provide a window treatment which conceals the pivot point bolt about which the slats are glued in a base which enhances the overall appearance of the window treatment.

It is yet a further object of the present invention to provide a window treatment which mounts on the outside of an arch flush on the wall, or which can be trimmed as an inside mount and, at the same time, can have the flowerbox added for increased aesthetic appearance.

Another object of the present invention is to provide a method for constructing a "peacocks tail" arch treatment in a simple and effective manner with a minimum amount of materials and in a relatively short period of time.

The foregoing objects have been achieved by providing sufficient number of slats of generally rectangular shape with a slightly concave/convex cross-section to make a semicircle for a particular measured arch. The bottom of each slat is provided with a hole. A valence approximately the width of the arch is also provided with a hole in the center and if necessary is notched at each end to insure that the valence will set back into the opening and flush with the wall. A second valence piece, slightly smaller in width than the first valence piece, is fabricated and put back to back with the first valence piece. When aligned, the two valence pieces have the hole going through both pieces so that a bolt can pass therethrough.

In accordance with the inventive method of the present invention, a bolt is passed through the front valence hole which is then laid down on a bench with the bolt shank projecting upwardly. The rectangular slats are then placed on the bolt with the convex side down, by alternating the slats with their free ends laying to the left then with the next one to the right, until all of the slats have been used. There will always be one more slat on either the left or the right side because there is always an odd number of slats used, e.g. between fifteen and thirty-three depending upon the arch size. The second valence hole is then passed over the bolt. The assembled slats are then laid over a flat surface. Starting with the back slat (i.e. closest to the second valence), it is positioned perpendicular to the valences. The second and third slats from the back are moved toward this perpendicular slat so that the corners of the slats meet. This process is repeated with succeeding slats from each side until a semicircle is formed.

Starting with the back slat, a spot of heat resistant, fast drying glue is placed on the right edge about four inches from the upper or free end of each slat. The next slat from the back is slightly overlapped beyond the spot, and a clamp is placed over the glue spot to hold the two slats together. The same type of glue spot is placed on the right edge of the second slat, and the third slat is moved from the back right side into position overlapping the second slat so that the two slats can be clamped together. This procedure is followed for all slats on the right side until the 0° to 90° arc is formed. The last slat is not glued to the front valence at this point. Then going back to the perpendicular slat, glue is placed on the left edge of the perpendicular slat, about four inches from the outside or free edge. The back left slot is moved to overlap slightly the perpendicular slat so that a clamp placed over the glue spot will hold the two slats together. This process is repeated for succeeding slats until the 270°-360° portion of the arch is filled. When the glue has dried thoroughly, the left and right outside corners can then be glued to the back of the front valence.

To finish the arch treatment, valence material can be placed on the front and back valences in a conventional manner. For example, a piece of channel panel can be cut in half, i.e. down the center, and four pieces of channel can be cut to cover the raw corner of the valence material. The channel panel piece is inserted between the valence material and the valence itself to give a finished appearance. With larger size valances, i.e. 60 inches and larger, plastic surgical tubing can be glued to the outer edges for added support and a more finished look. On arches 72 inches or wider, it may be deemed desirable to glue a second slat to the perpendicular slat for added rigidity. A hole can be drilled in the added perpendicular slat so that the top of the arch can be wired to a hook screwed into the wall above the arch providing added support and taking some of the weight of the center of the valences.

BRIEF DESCRIPTION OF THE DRAWINGS

These and other features, objects and advantages of the present invention will become more apparent from the following detailed description of several presently preferred embodiments when taken in conjunction with the accompanying drawings wherein.

DETAILED DESCRIPTION OF THE DRAWINGS

Figure 1:
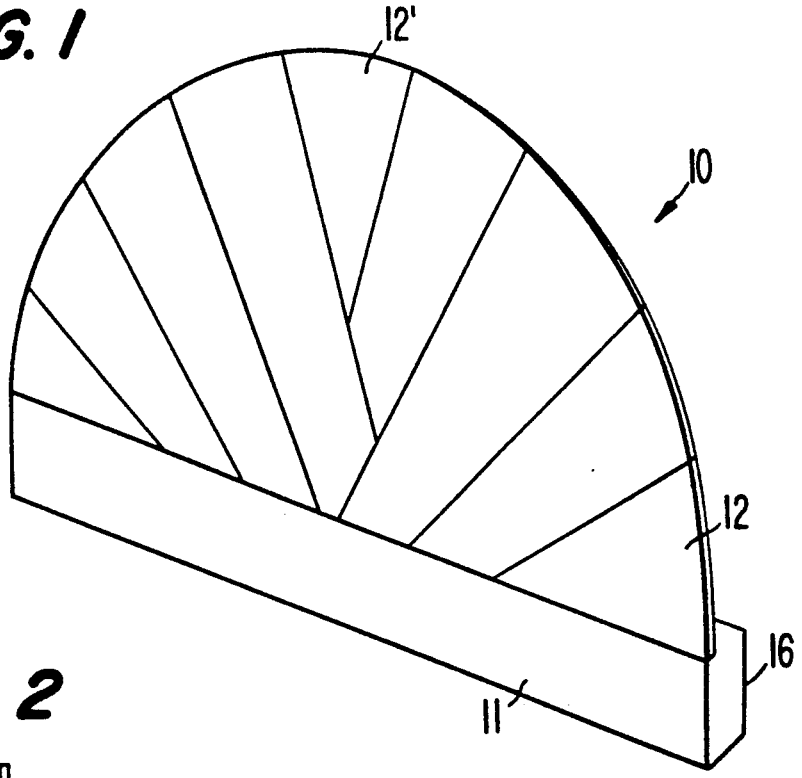
FIG. 1 is a perspective view of the finished "peacocks tail" arch treatment made in accordance with the method of the present invention.
Figure 2:
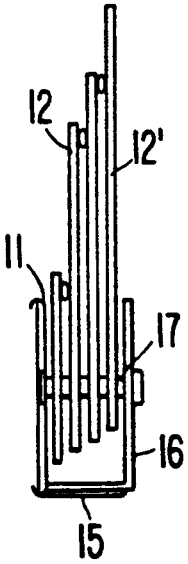
FIG. 2 is an end view of the arch treatment shown in FIG. 1.
Figure 5A:
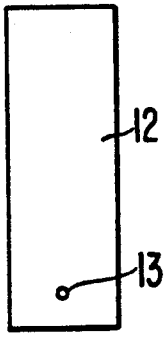
FIGS. 5A and 5B are front elevation and end views of an individual slot showing its rectangular and concave-convex shapes, respectively.
Figure 3:
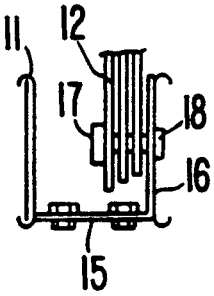
FIG. 3 is an end view similar to FIG. 2 but without the slats thereon showing an embodiment which uses a window box.
Figure 5B:
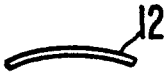

Referring now to FIG. 1, the arch treatment in accordance with the present invention is designated generally by the numeral 10. The arch treatment 10 is comprised of a front valence 11 and a series of rectangular slats 12, the middle one of which designated as 12' extends perpendicular to the valence 11 (0° position), a number of which extend from, as seen in FIG. 1, from the perpendicular slat 12' downwardly toward the right (the 0°-90° position) and a number of which extend downwardly and to the left from the perpendicular slat 12' (the 270° to 360° position). As viewed from their free edge forming the curved arch, as seen in FIGS. 5A and 5B, the slats 12 have a slightly cupped or convex-concave cross-section with the convex side facing toward the front of the arch.

By way of non-binding illustrative example, the arch treatment is constructed as follows according to the following novel method. The actual width of the arch is measured. To that measurement, three-quarters inch is added and the total is then divided by two. One-eighth inch is then added to that divided value. This is the measurement of the slat length, and enough rectangular slats 12 are cut to make a semicircle. For instance, it is common to use between 15 and 33 slats depending upon the size of the arch. The number of slats used will, however, always be an odd number.

Then a one-quarter inch hole 13 is drilled in the center at each bottom of each slat 12 about three-eighths inch from the pivot end. A valence piece is then cut to the width of the arch plus one-half inch. A one-quarter inch hole 14 is then drilled in the center of the valence 11 at about one and three-quarters inches from the bottom of the valence 11. About one and one-half inch of the back bottom 15 of the valence 11 is cut off to make it about one and one-half inches in depth. The valence 11 is notched (not shown) about one-half inch from each end and up to the back of the front valence 11 to assure that the valence will set back into the opening and will be flush to the wall. A second valence piece 16 is cut the actual width of the arch minus one-half inch. For arches up to 52 inches wide, a channel panel can be used instead of the second valence 16. The second valence piece 16 is put back to back with the first or front valence 11 and centered with the bottom of the second valence 16 inside and above the bottom of the first valence 11. A one-quarter inch hole is drilled in the center of the second valence 16 using the hole 14 in the center of the first valence 11 as a guide. An amount, e.g. one and one-half inches, is cut off from the depth of the second valence 16 to make it have a width of one and one-half inch depth.

A quarter inch bolt 17, which is one to three inches long, is passed through front valence hole 14. The valance 11 is then laid face down on a bench with the shank of the bolt 17 having threads thereon sticking straight up. The slats 12 are placed on the bolt 17 with their convex side down. The slats 12 are laid in an alternating manner with the free ends laying to the left and to the right, until all slats are used. The bolt 17 is then passed through the back side of the second valence 16, and a nut 18 is screwed thereon to hold the assembly together. When the valences 11, 16 are stood upright into their normal position, the edge of the front valence 11 can be seen from the top as well as the edges of the alternating left and right slats (with always one more slat on either the right or left side so that there is always an odd number of slats), and the edge of the back valence.

Figure 4:
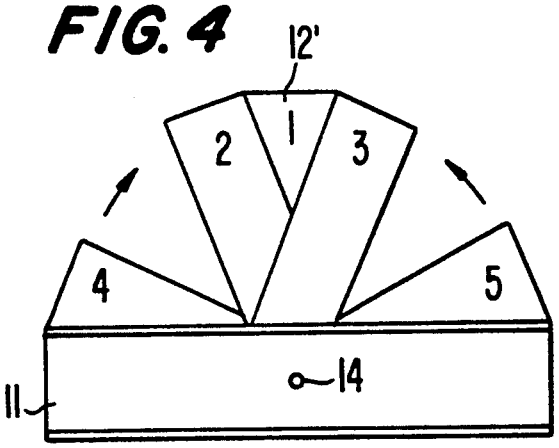
FIG. 4 is a front view showing some of the slats and the order in which they are assembled on the valence to construct the arch treatment shown in FIG. 1.

The assembled slats are again laid down with the back valence 16 on a flat surface. The backmost slat designated by the numeral 1 in FIG. 4, is positioned perpendicular to the valences 11, 16. The second and third slats numbered 2 and 3, respectively, are moved from the back, one from the right stack and one from the left stack toward the perpendicular slat 1 so that the corners of the slats meet. This process is repeated with succeeding slats from each side until the semicircle is formed.

Now, starting with the back slat 1, a spot of heat resistant, fast drying glue is placed on the right edge about four inches from the outside or free end. The next slat 2 from the back right is moved to overlap by about one-eighth inch over the back slat 1. A standard clamp (not shown) is then placed over the glue spot to hold the two slats 1 and 2 together. A spot of glue is now placed on the right edge of the second slat 2, and a third slat is moved from the back right side into a position overlapping the second slat 2 by about one-eighth inch. These two slats are then clamped together. The same procedure is followed for all slats on the right side until the zero to 90° arc is formed. The last slat is, however, not glued to the valence 11 at this point.

Returning now to the perpendicular or back slat 1, a spot of glue is placed on the left edge about four inches from the outside edge and a back left slat 3 is moved up to overlap one-eighth inch over the perpendicular slat 1. A clamp is placed over the glue spot to hold the two slats 1 and 3 together. This process is repeated, as was the case with the 0° to 90° arc, until the 270°–360° arc is formed. The glue is allowed to dry thoroughly. With the arch laying flat, the left and right outside corners of the bottommost slats are then glued to the back of the front valence 11.

Upon completion of the arch forming process, a valence material is placed on the front and back valences 11, 16. To this end, a piece of channel panel is cut in half down the center, and four pieces of channel are cut to cover the raw corner edge of the valence material. The channel panel piece is inserted between the valence material and the valence itself to give a finished appearance. On larger sizes, e.g. 60 inches and above, plastic surgical tubing can be glued to the outer edges for added support and a more finished look. Furthermore, on arches 72 inches wide, it may be necessary to glue a second slat to the perpendicular slat for added rigidity, and a one-quarter inch hole can be drilled in the added slat so that the top of the arch can be wired to a hook screwed into the wall above the arch providing added support and taking some of the weight of the center of the valences.

Furthermore, a silk-flower box can be added to the front of the arch treatment by following the above steps. When the glue is totally dry, but without gluing the assembled arch slats to the front valence 11, the bolt 17 can be removed from the front valance 11. The assembled arch slats 12 are removed. A hole, e.g. one-quarter inch hole, is drilled in the center of the back valence 16. The bolt 17 is then put through the slats 12 from the front and through the back valence 16 so that the arch is mounted to the back valence 16. Four holes, about three-sixteenths inch in diameter, are drilled through the bottoms of the front and back valences where they overlap. The valences are bolted together so that they form a box. The distance between the back and front valences 16, 11, respectively, is measured, and two channel pieces are cut. Conventional plastic corners are placed on the ends of the channel pieces which are then slipped on to each end of the valences 11, 16 to form the flower box.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An above-window arch treatment comprising at least one valence adapted to fit a window, and a plurality of approximately rectangular slats fixedly joined to each other and to the at least one valence to form an arcuate portion of a circle, wherein one of the slats farthest from the at least one valence is arranged perpendicular to the at least one valence, and wherein the remaining slats between the at least one valence and the perpendicularly arranged slat extend in an alternating manner toward a right-hand side and a left-hand side in relation to the perpendicularly arranged slat.

2. The above-window arch treatment according to claim 1, wherein the slats are provided with holes near one end thereof, the at least one valence is provided with a hold in a central portion thereof, and a securing device passes through the holes of the at least one valence and the slats.

3. The above-window arch treatment according to claim 1, wherein the at least one valence includes two valences operatively associated with the slats.

4. An above-window arch treatment, comprising at least one valence adapted to fit a window, and a plurality of approximately rectangular slats fixedly joined to each other and to the at least one valence to form an arcuate portion of a circle, wherein glue is provided between the slats to fixedly join the slats to each other.

5. The above-window arch treatment according to claim 4, wherein the slats are provided with holes near one end thereof, the at least one valence is provided with a hole in a central portion thereof, and a securing device passes through the holes of the at least one valence and the slats.

6. The above-window arch treatment according to claim 5, wherein one of the slats furthest from the at least one valence is arranged perpendicular to the at least one valence.

7. The above-window arch treatment according to claim 6, wherein the remaining slats between the at least one valence and the perpendicularly arranged slat extend in an alternating manner toward a right-hand side and a left-hand side in relation to the perpendicularly arranged slat.

8. The above-window arch treatment according to claim 7, wherein the at least one valence includes two valences operatively associated with the slats.

9. The above-window arch treatment according to claim 8, wherein the two valences form a flower box including end pieces.

10. A method for constructing an above-window arch treatment, comprising the steps of measuring an above-window arch, producing generally rectangular slats sufficient in number for the arch treatment, producing a first valence adapted to fit the arch, associating the slats with the first valence in a manner in which the slats are alternated toward right and left sides of the first valence as viewed in the direction toward a top edge of the first valence, producing a second valence, associating the second valence with the slats and first valence to form an assembly on which the valences are parallel to each other, moving a first slat closest to the second valence perpendicular to the first and second valences, moving a second slat next to the perpendicular slat so as to overlap an edge on one side of the perpendicular slat, permanently securing the first and second slats together, moving a third slat next to the second slat so as to overlap an edge on the other side of the perpendicular slat, permanently securing the first and third slats together, and permanently joining successive slats to each other on each side of the perpendicular slat until the desired arch shape is formed.

11. The method according to claim 10, further including the step of permanently joining the slats immediately adjoining the first valence to the first valence.

12. The method according to claim 11, further including the step of disassociating the first and second valences, permanently joining the permanently joined slats to the second valence, and again associating the first and second valences to form a box for flowers and the like.

13. A method for constructing an above-window arch treatment, comprising the steps of:

(a) providing at least one valence adapted to fit a window; and (b) permanently and fixedly joining a plurality of approximately rectangular slats to each other and to the at least one valence to form an arcuate portion of a circle, by gluing said slats together so as to fixedly and permanently join said slats to each other.

14. A method according to claim 13, wherein said slats are provided with holes near one end thereof, the at least one valence is provided with a hole in a central portion thereof, and wherein step (b) comprises passing a securing device through the holes of the at least one valence and the slats.

15. A method to claim 13, wherein step (b) comprises arranging one of the slats farthest from the at least one valence perpendicular to the at least one valence.

16. A method according to claim 15, wherein step (b) further comprises arranging the remaining slats between the at least one valence and the perpendicularly arranged slat so as to extend in an alternating manner toward a right-hand side and a left-hand side in relation to the perpendicularly arranged slat.

17. A method according to claim 16, wherein step (a) comprises providing two valences in operative association with said slats.

* * * * *